US007782350B2

(12) United States Patent
Tanaka et al.

(10) Patent No.: US 7,782,350 B2
(45) Date of Patent: Aug. 24, 2010

(54) PRINTING APPARATUS, PRINTING SYSTEM, PRINTHEAD TEMPERATURE RETAINING CONTROL METHOD

(75) Inventors: Hirokazu Tanaka, Tokyo (JP); Hidehiko Kanda, Yokohama (JP); Atsushi Sakamoto, Kawasaki (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 11/940,013

(22) Filed: Nov. 14, 2007

(65) Prior Publication Data

US 2008/0143809 A1 Jun. 19, 2008

(30) Foreign Application Priority Data

Dec. 13, 2006 (JP) ..... 2006-336376

(51) Int. Cl.
*B41J 2/00* (2006.01)

(52) U.S. Cl. ..... 347/189

(58) Field of Classification Search ..... 347/189, 347/194–196, 191–192, 188, 19; 400/120.09, 400/120.14

See application file for complete search history.

(56) References Cited

U.S. PATENT DOCUMENTS

| | | | | |
|---|---|---|---|---|
| 5,168,284 | A | 12/1992 | Yeung | |
| 5,459,498 | A | 10/1995 | Seccombe et al. | |
| 5,642,142 | A | 6/1997 | Bohorquez | |
| 5,657,061 | A | 8/1997 | Seccombe et al. | |
| 5,673,069 | A | 9/1997 | Canfield et al. | |
| 5,726,690 | A | 3/1998 | Bohorquez et al. | |
| 5,736,995 | A | 4/1998 | Bohorquez et al. | |
| 5,745,132 | A | 4/1998 | Hirabayashi et al. | |
| 5,861,895 | A | 1/1999 | Tajika et al. | |
| 6,857,717 | B2 | 2/2005 | Misumi | |
| 2004/0196352 | A1 * | 10/2004 | Busch et al. | 347/189 |

FOREIGN PATENT DOCUMENTS

| | | |
|---|---|---|
| CN | 1439519 | 9/2003 |
| EP | 0 600 648 | 6/1994 |
| JP | 5-31906 | 2/1993 |
| JP | 5-92565 | 4/1993 |
| JP | 6-278291 | 10/1994 |
| JP | 2004-160685 | 6/2004 |

* cited by examiner

*Primary Examiner*—K. Feggins
(74) *Attorney, Agent, or Firm*—Fitzpatrick, Cella, Harper & Scinto

(57) ABSTRACT

The apparatus and method can suppress an increase in power consumption and reduce ink density unevenness caused by variations in the amount of ink discharge upon performing printhead temperature retaining control. The printing apparatus, which prints on a print medium by scanning a printhead having a printing element for generating thermal energy, includes a determination unit which predicts a maximum temperature which the printhead reaches in printing, and determines a target temperature based on the predicted maximum temperature, and an adjustment unit which adjusts the temperature of the printhead in printing on the basis of the target temperature.

11 Claims, 13 Drawing Sheets

FIG. 6

| | MAXIMUM ARRIVAL TEMPERATURE $T_{max}$ (°C) | | | |
|---|---|---|---|---|
| | $T_{max} \leqq 40$ | $40 < T_{max} \leqq 50$ | $50 < T_{max} \leqq 60$ | $60 < T_{max}$ |
| TARGET RETAINED TEMPERATURE $T_k$ (°C) | $T_{max}$ | $0.98 \times T_{max}$ | $0.95 \times T_{max}$ | 57 |

FIG. 11A

TEMPERATURE SETTING TABLE 1
(FOR SPECIAL-PURPOSE PHOTO PAPER)

| | | PRINT MODE | | |
|---|---|---|---|---|
| | | QUICK | NORMAL | FINE |
| PRINT MEDIUM SIZE | L SIZE, POST CARD, 4×6" | 42°C | 44°C | 50°C |
| | B5, A4 | 52°C | 54°C | 60°C |
| | B4, A3 | 55°C | 60°C | 65°C |

FIG. 11B

TEMPERATURE SETTING TABLE 2
(FOR PLAIN PAPER)

| | | PRINT MODE | | |
|---|---|---|---|---|
| | | QUICK | NORMAL | FINE |
| PRINT MEDIUM SIZE | L SIZE, POST CARD, 4×6" | 34°C | 34°C | 38°C |
| | B5, A4 | 36°C | 38°C | 44°C |
| | B4, A3 | 45°C | 50°C | 55°C |

FIG. 12

| | AMBIENT TEMPERATURE Ta (°C) | | | |
|---|---|---|---|---|
| | Ta ≦ 20 | 20 < Ta ≦ 25 | 25 < Ta ≦ 30 | 30 < Ta |
| INCREASED TEMPERATURE (°C) | 0.95 × (Ta−23) | (Ta−23) | 0.95 × (Ta−23) | 0.90 × (Ta−23) |

PRINTING APPARATUS, PRINTING SYSTEM, PRINTHEAD TEMPERATURE RETAINING CONTROL METHOD

BACKGROUND OF THE INVENTION

1. Field of the Invention

The present invention relates to a printing apparatus, printing system, and printhead temperature retaining control method. Particularly, the present invention relates to a printing apparatus which prints an image on a print medium by discharging ink using a printhead, a printing system including the printing apparatus, and a temperature retaining control method for the printhead.

2. Description of the Related Art

These days, performance demand is growing for printing apparatuses used as a printer, copying machine, and facsimile machine. The printing apparatus is required to print high-resolution images like a silver halide photograph, in addition to high-speed printing and full-color printing. To meet these demands, an inkjet printing apparatus can discharge small ink droplets at high frequency. The inkjet printing apparatus is superior to printing apparatuses using other printing methods in terms of high-speed printing and high-quality printing. Of inkjet printing apparatuses, a printing apparatus which employs a thermal inkjet printing method of discharging ink using bubbles generated by a heater (electrothermal transducer) can print high-resolution images because nozzles can be arrayed at high density.

The thermal inkjet printing method (to be simply referred to as an inkjet printing method hereinafter) has the following features.

According to the inkjet printing method, a heater is energized to generate thermal energy and generate bubbles in the ink. The growth of the generated bubbles is greatly influenced by the ambient ink temperature. At the interface between the bubbles and the ink, a process in which gas molecules in bubbles fly into the ink, and a process in which liquid molecules in the ink fly out of bubbles occur. The temperature of the ink near the bubbles influences the latter process. If the ink temperature is high, many molecules fly out of the ink into the bubbles, and the bubbles grow relatively large. To the contrary, if the ink temperature is low, a relatively small number of molecules fly out of the ink into the bubbles, and the bubble size is smaller than that at high ink temperature. The bubble size influences the volume of the ink (to be referred to as an ink discharge amount hereinafter) pushed out of the nozzle.

In the inkjet printing apparatus, the amount of ink discharge is strongly influenced by the ink temperature near the heater (to be referred to as an ink temperature hereinafter). The amount of ink discharge is large when the ink temperature is high, and small when it is low.

According to the inkjet printing method, the temperature near the heater during printing is higher than that at the start of printing.

This is because not all the thermal energy generated by the heater contributes to the bubble generation energy. Residual energy after subtracting, from the thermal energy, energy used to generate bubbles is stored as thermal energy in neighboring ink or a member such as a printhead substrate. Even the stored thermal energy is dissipated by thermal conduction or thermal radiation. However, the heater supplies thermal energy during printing, so the ink temperature continues to rise if the dissipation amount of thermal energy is smaller than its amount of supply. The temperature of ink which is not used to print and does not receive thermal energy from the heater continues to drop until it reaches an equilibrium state with the ambient temperature. In other words, a portion at which data is printed at high ink temperature, and a portion at which data is printed at a temperature as low as room temperature exist on a print medium depending on the heater driving count, that is, print data.

For this reason, the amount of ink discharge changes between a high-temperature printed portion and a low-temperature printed portion. When an image such as a photograph is printed, density unevenness may appear in the image printed on a print medium, degrading the print quality.

To prevent variations in the amount of ink discharge depending on the ink temperature, there has conventionally been known a temperature retaining control method of suppressing variations in the amount of ink discharge. According to this method, the printhead is heated to a given temperature before the start of printing, and adjusted to retain the temperature in the printhead during printing. For example, Japanese Patent Laid-Open No. 6-278291 proposes a method of presetting a temperature (reference temperature) at which the variation width of the amount of ink discharge can be decreased, and adjusting the printhead temperature by heating the printhead substrate to the reference temperature.

Japanese Patent Laid-Open No. 2004-160685 proposes a temperature retaining control method of heating a printhead substrate and changing, in accordance with the print mode, a temperature (reference temperature) serving as a reference upon adjusting the printhead temperature. More specifically, in a print mode in which printing is performed at high speed, the reference temperature is set relatively high to reduce the recovery operation and increase the throughput. In a print mode in which printing is performed at high image quality, the reference temperature is set relatively low to decrease the amount of ink discharge and print at high resolution.

Japanese Patent Laid-Open No. 5-31906 discloses an inkjet printing apparatus which prints while maintaining a printhead at a temperature higher than the ambient temperature to suppress variations in the amount of ink discharge over a wide temperature range by PWM control.

However, the maximum temperature which the printhead reaches during printing greatly changes depending on print conditions such as print data and the heater driving count. For example, the printhead temperature does not rise so high when printing a document or an image at low print density or when printing an image in a small print area. In this case, the maximum temperature which the printhead reaches is often stabilized at a temperature as low as room temperature. At this time, if the printhead temperature is adjusted to a reference temperature higher than this temperature, a large amount of thermal energy needs to be applied for the temperature adjustment, increasing power consumption. A relatively long heating time is necessary to heat the printhead substrate to the reference temperature. The higher the target reference temperature becomes, the longer the heating time also becomes. As a result, the throughput of the printing apparatus decreases.

Problems in the conventional arts will be listed in detail below.

Japanese Patent Laid-Open No. 6-278291 proposes a method of raising the reference temperature to increase the amount of ink discharge in order to fill the space between dots when printing at low resolution. Upon printing at low resolution, the heater driving count decreases, and the maximum temperature which the printhead reaches during printing drops. Nevertheless, to raise the reference temperature, a large amount of thermal energy must be applied. This reference does not explicitly disclose a method of changing the reference temperature in accordance with the degree of temperature rise of the printhead. When a document or image is so printed as to keep constant at low temperature the maximum temperature the printhead reaches during printing, as described above, a large amount of thermal energy is wastefully applied.

Japanese Patent Laid-Open. No. 2004-160685 proposes a method of retaining a high printhead temperature to improve head recovery in order to reduce the recovery operation and increase the throughput in the high-speed print mode. This reference also proposes a method of retaining a low printhead temperature to decrease the amount of ink discharge in order to print an image at high resolution in the high-quality print mode. However, when print data such as a text requiring a small number of heater driving counts is used even in high-speed printing, the maximum printhead temperature remains at low level. Thus, a large amount of thermal energy is applied for a long time in order to keep the printhead temperature high. When high-quality print data like a photographic image is used even in high-quality printing, the heater driving count is high and the maximum printhead temperature reaches high level. If the printhead is maintained at low temperature, the printhead temperature greatly varies, and the amount of ink discharge also greatly varies. Accordingly, an image suffering conspicuous ink density unevenness is output.

Japanese Patent Laid-Open No. 5-31906 proposes a method of retaining a printhead temperature higher than the ambient temperature. However, when a high-quality image like a photographic image is printed, the maximum temperature the printhead reaches during printing may exceed the retained printhead temperature, and the amount of ink discharge may vary. When print data such as text data requiring a small number of heater driving counts is printed, the maximum printhead temperature remains relatively low, but the printhead is retained at high temperature. This results in wastefully consuming power.

As summarized, when temperature retaining control is executed based on a reference temperature higher than the maximum temperature which the printhead actually reaches during printing, ink density unevenness upon variations in the amount of ink discharge can be reduced. However, a large amount of thermal energy is wastefully applied, increasing power consumption. If temperature retaining control is executed based on a reference temperature lower than the maximum temperature which the printhead actually reaches, the printhead temperature greatly varies, and ink density unevenness appears in an output image.

SUMMARY OF THE INVENTION

Accordingly, the present invention is conceived as a response to the above-described disadvantages of the conventional art.

For example, a printing apparatus, printing system, and printhead temperature retaining control method according to this invention are capable of suppressing an increase in power consumption and reducing ink density unevenness caused by variations in amount of ink discharge upon performing printhead temperature retaining control.

According to one aspect of the present invention, preferably, there is provided a printing apparatus which prints on a print medium by scanning a printhead with a printing element for generating thermal energy, the apparatus comprising: determination means for predicting a maximum temperature which the printhead reaches in printing, and determining a target temperature on the basis of the predicted maximum temperature; and adjustment means for adjusting a temperature of the printhead in printing to the target temperature.

According to another aspect of the present invention, preferably, there is provided a printing system including a printing apparatus and a host connected to the printing apparatus, the printing apparatus including a printhead with a printing element for generating thermal energy, and adjustment means for adjusting a temperature of the printhead in printing to a target temperature, wherein the host includes: determination means for predicting a maximum temperature which the printhead reaches in printing, and determining the target temperature on the basis of the predicted maximum temperature; and transmission means for transmitting information on the target temperature to the printing apparatus, the printing apparatus includes reception means for receiving the information on the target temperature from the host, and the adjustment means adjusts the temperature of the printhead to the target temperature on the basis of the received information on the target temperature.

According to still another aspect of the present invention, preferably, there is provided a printhead temperature retaining control method in a printing apparatus capable of adjusting, to a target temperature, a temperature of a printhead with a printing element for generating thermal energy, the method comprising: a determination step of predicting a maximum temperature which the printhead reaches in printing, and determining the target temperature on the basis of the predicted maximum temperature; and an adjustment step of adjusting the temperature of the printhead on the basis of the determined target temperature.

The invention is particularly advantageous since the maximum temperature which the printhead reaches during printing is predicted and temperature retaining control is executed to adjust the printhead temperature so as to retain the temperature in the printhead at a target temperature determined using the predicted maximum temperature. The invention can, therefore, suppress an increase in power consumption and reduce occurrence of ink density unevenness caused by variations in amount of ink discharge.

Further features of the present invention will become apparent from the following description of exemplary embodiments (with reference to the attached drawings).

BRIEF DESCRIPTION OF THE DRAWINGS

FIG. 6 is a table showing the relationship between the maximum arrival temperature and target retained temperature of the printhead;

FIGS. 11A and 11B are tables showing two types of target retained temperature settings based on the print medium size and print mode;

FIG. 12 is a table showing an increased temperature setting table; and

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "link" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

<Basic Structure of Inkjet Printing Apparatus (FIGS. 1A to 3)>

Figure 1A:
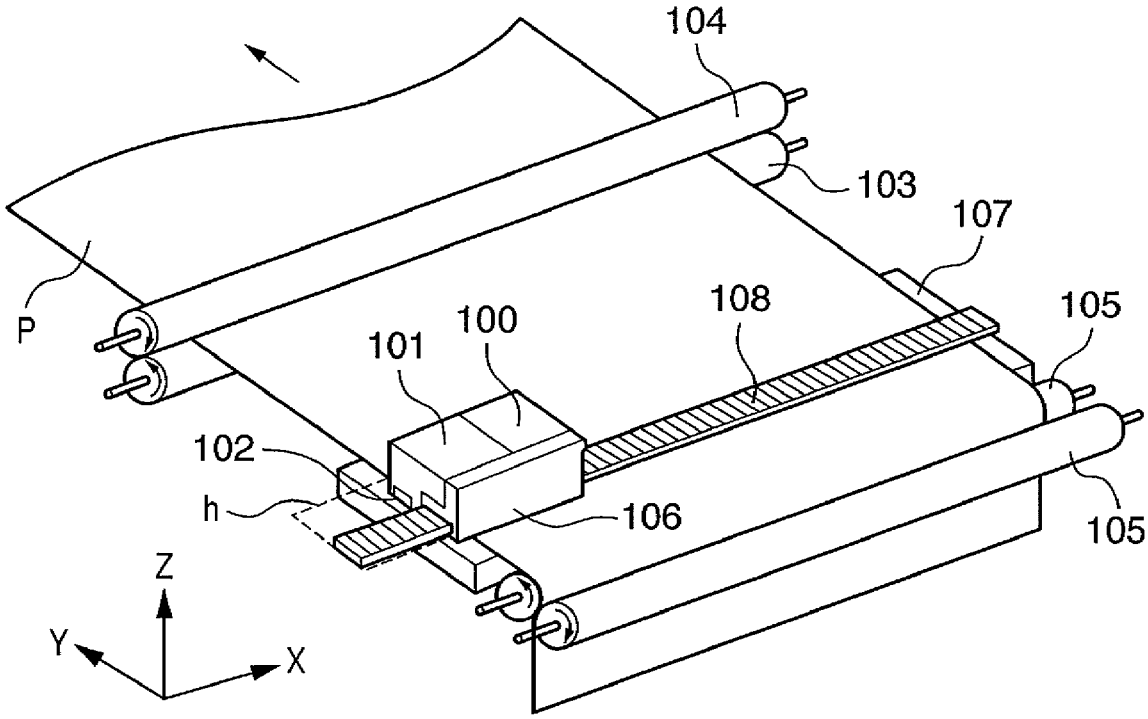
FIGS. 1A and 1B are a perspective view and sectional view, respectively, showing the schematic structure of a printing apparatus according to a typical embodiment of the present invention.
Figure 1B:
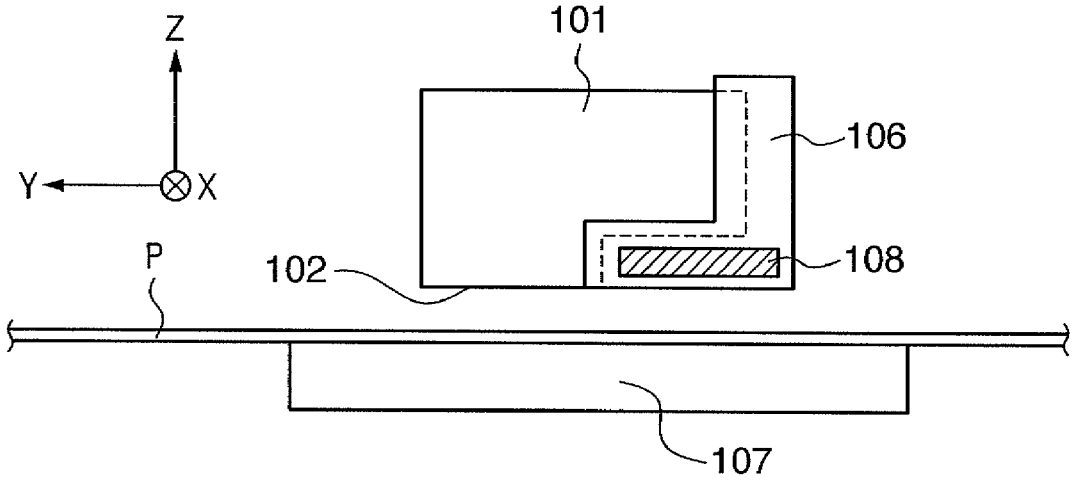

FIGS. 1A and 1B are views showing the schematic structure of a printing apparatus according to a typical embodiment of the present invention.

FIG. 1A is a perspective view of the printing apparatus, and FIG. 1B is a sectional view taken along the line Y-Z passing through a printhead in FIG. 1A.

In FIGS. 1A and 1B, printheads 100 and 101 are integrated with ink tanks. Although FIGS. 1A and 1B show an ink tank-integrated printhead, the printhead is not limited to this type and the printhead and ink tank may also be separable from each other.

The ink tank of the printhead 100 stores black ink, light cyan ink, and light magenta ink, whereas that of the printhead 101 stores cyan ink, magenta ink, and yellow ink. The printheads 100 and 101 have the same structure except for the inks stored in them. The printheads 100 and 101 have arrays of orifices 102 corresponding to the respective color inks.

A conveyance roller 103 and auxiliary roller 104 cooperate with each other to rotate in directions indicated by arrows in FIG. 1A while pinching a print medium P, thereby properly conveying it in the Y direction. Feed rollers 105 feed the print medium P, and also pinch the print medium P, similar to the conveyance roller 103 and auxiliary roller 104. A carriage 106 supports the printheads 100 and 101, and moves them along with printing. The carriage 106 stands by at a home position h indicated by a dotted line in FIG. 1A when no printing is performed or the printhead recovery operation or the like is performed. A platen 107 stably supports the print medium P at the print position. A carriage belt 108 moves the carriage 106 in the X direction.

Figure 2A:
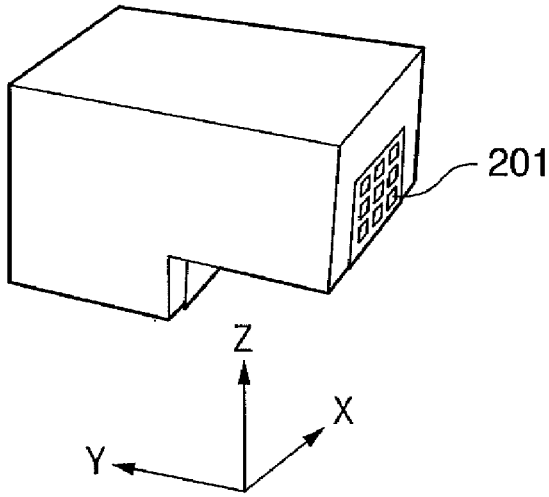
FIGS. 2A, 2B, and 2C are a perspective view, plan view, and enlarged view, respectively, showing the structure of a printhead.
Figure 2B:
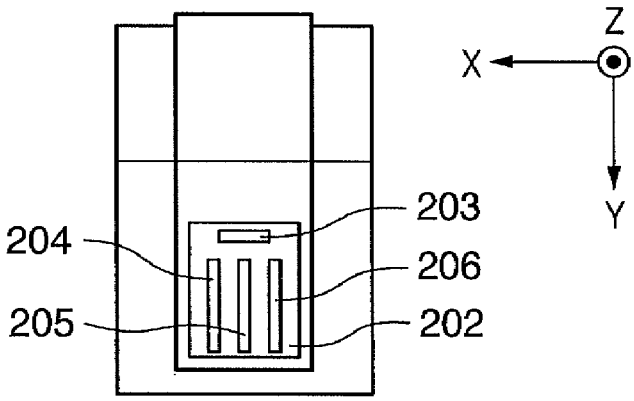
Figure 2C:
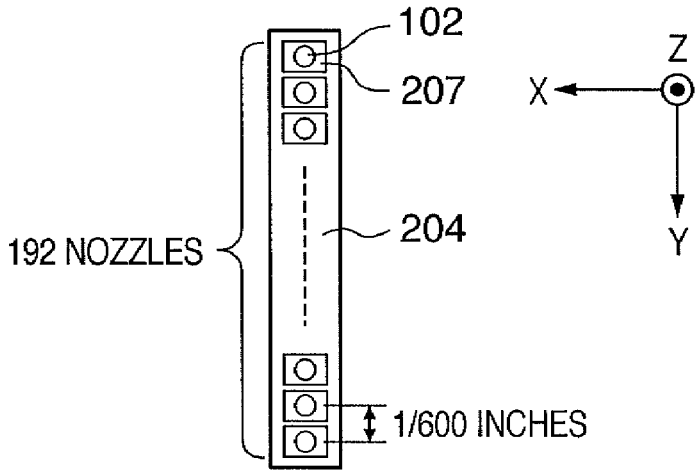

FIGS. 2A to 2C are views showing the printhead structure. Since the printheads 100 and 101 have the same structure, the structure of the printhead 101 will be explained.

FIG. 2A is a perspective view of the printhead 101. FIG. 2B is a plan view of the bottom of the printhead when viewed from the Z direction. FIG. 2C is an enlarged view of the periphery of orifices in FIG. 2B.

In FIG. 2A, the printhead 101 receives a print signal from the printing apparatus main body via contact pads 201. The printhead 101 also receives power necessary to drive the printhead via the contact pads 201.

In FIG. 2B, reference numeral 202 denotes a printhead chip; and 203, a diode sensor which detects the temperature of the printhead substrate. Since it is difficult to directly detect the ink temperature, in general, the temperature of the printhead substrate (to be referred to as a printhead temperature hereinafter) is detected and used as the ink temperature. As an arrangement for detecting the printhead temperature, a metal thin-film sensor or the like is also available in addition to the diode sensor. An orifice array 204 discharges cyan ink, an orifice array 205 discharges magenta ink, and an orifice array 206 discharges yellow ink. These orifice arrays have the same discharge orifice structure and the like except for the ink color.

FIG. 2C is an enlarged view of the orifice array 204 which discharges cyan ink.

In FIG. 2C, the orifices 102 are arranged on the cyan orifice array 204. A heater 207 is arranged below each orifice 102 (in the Z direction) to generate bubbles and discharge ink. The number of orifices 102 is 192, and the orifices are arrayed at intervals of 1/600 inches and at a printed pixel density of 600 dpi.

The orifice 102 can discharge an ink droplet of about 2 pl. To stably discharge ink droplets, the discharge frequency of the heater 207 is 24 kHz. The speed, in the main scanning direction (X-axis direction), of the carriage which supports the printheads 100 and 101 is 24,000 (dots/sec)÷1,200 (dots/inch)=20 inches/sec when discharging ink droplets at an interval of 1,200 dpi in the main scanning direction. The heater 207 can also serve as a temperature retaining heater by supplying a driving pulse short enough not to discharge ink.

This temperature retaining control will be called short-pulse heating control. The embodiment will describe a temperature retaining control method using short-pulse heating control. However, an ink temperature retaining heater may also be arranged in addition to an ink discharge heater and perform temperature retaining control.

Figure 3:
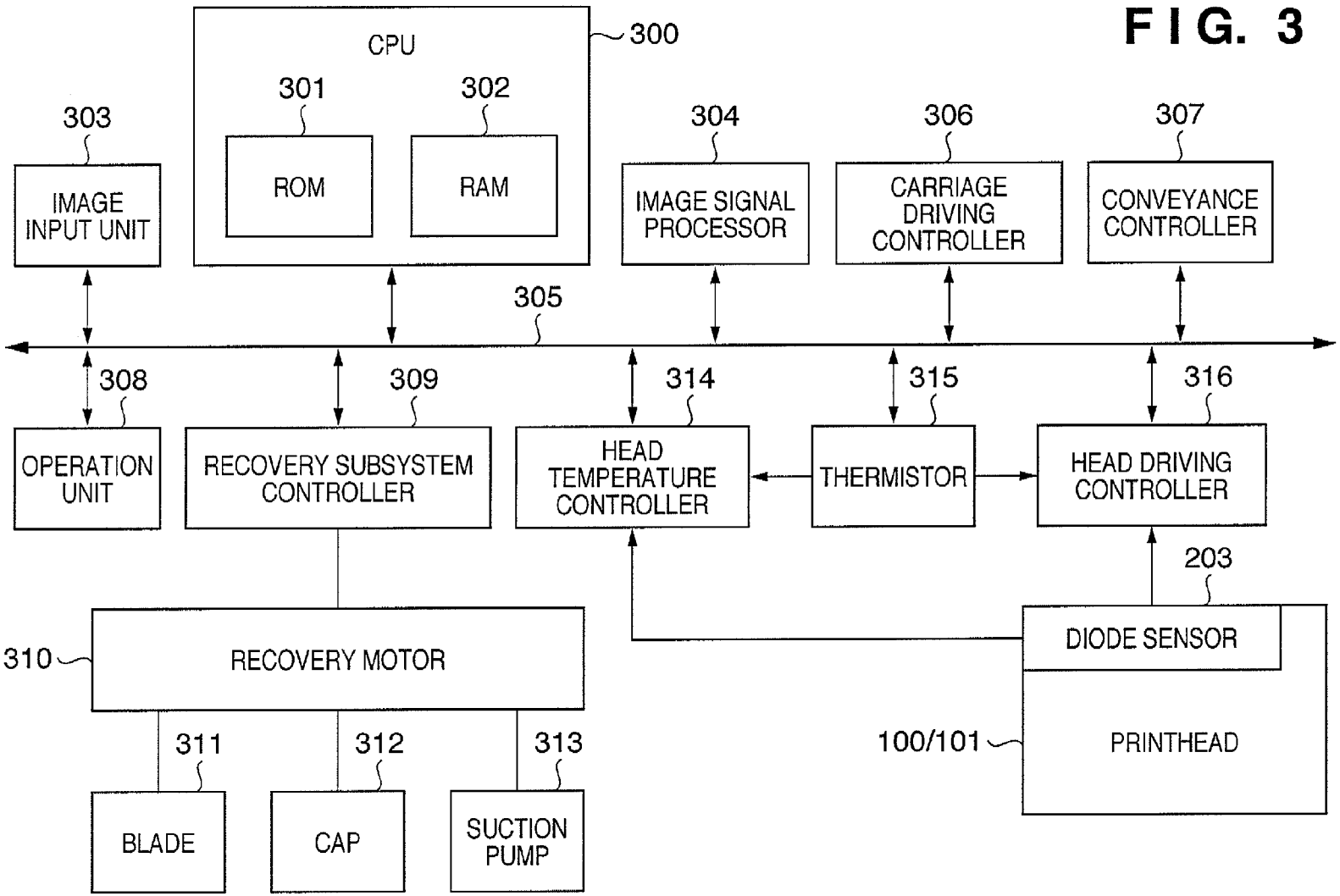
FIG. 3 is a block diagram showing the control arrangement of the printing apparatus shown in FIG. 1.

FIG. 3 is a block diagram showing the control arrangement of the printing apparatus.

The building elements of the control arrangement shown in FIG. 3 can be roughly classified into a control means implemented by software and a control means implemented by hardware. The control means implemented by software includes an image input unit 303, corresponding image signal processor 304, and CPU 300, all of which access a main bus line 305. The control means implemented by hardware includes an operation unit 308, recovery subsystem controller 309, head temperature controller 314, head driving controller 316, carriage driving controller 306 in the main scanning direction, and conveyance controller 307 in the subscanning direction.

The CPU 300 generally comprises a ROM 301 and RAM 302. The CPU 300 gives print conditions appropriate for input information, and drives the ink discharge heaters 207 in the printheads 100 and 101, thereby printing. The ROM 301 prestores a program for executing a printhead recovery timing chart. The CPU 300 gives recovery conditions such as preliminary discharge conditions to the recovery subsystem controller 309, printheads 100 and 101, and the like as needed. The ROM 301 also stores a program for executing printhead temperature retaining control (to be described later). The image input unit 303 receives image data, commands, status signals, and the like from an external device (host) connected to the printing apparatus. A recovery motor 310 drives the printheads 100 and 101, and a cleaning blade 311, cap 312, and suction pump 313 which are spaced apart from the printheads 100 and 101 and face them.

The head driving controller 316 causes the printheads 100 and 101 to perform preliminary discharge and ink discharge by driving the ink discharge heater 207 based on the output value of a thermistor 315 which detects the ambient temperature of the printing apparatus, and that of the diode sensor 203 which detects the printhead temperature. The head driving controller 316 also causes the printheads 100 and 101 to perform ink temperature adjustment for temperature retaining control (to be described later). The head driving controller 316 can also perform double-pulse driving control by driving the ink discharge heater 207 based on a driving signal composed of a pre-pulse and main pulse.

Embodiments concerning a printhead temperature retaining control method in the printing apparatus having the above-described arrangement will be described.

First Embodiment

Figure 4:
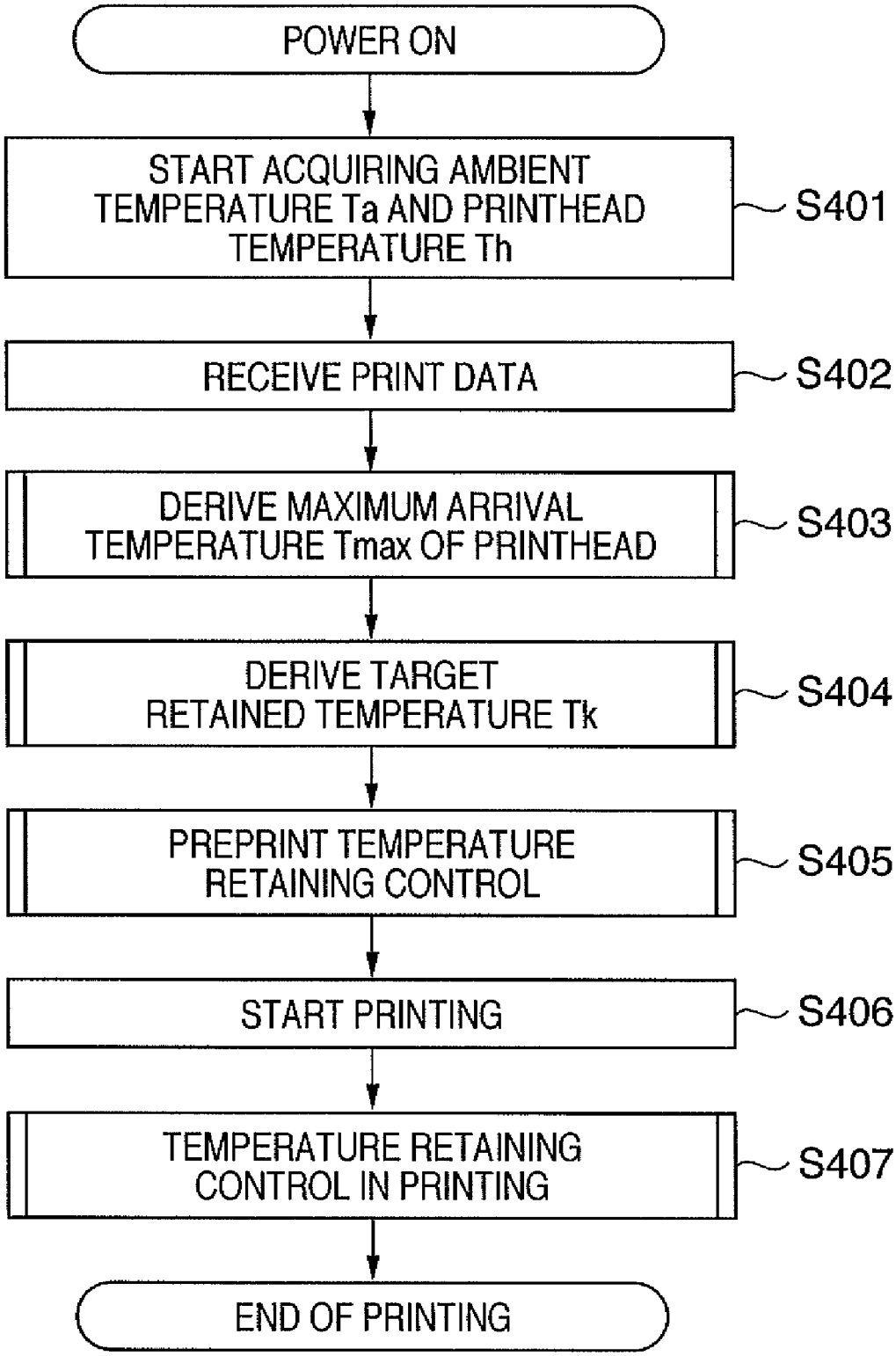
FIG. 4 is a flowchart showing an outline of printhead temperature retaining control according to the first embodiment.

FIG. 4 is a flowchart showing an outline of a printhead temperature retaining control method according to the first embodiment.

When the printing apparatus is turned on, an ambient temperature $T_a$ of a printing apparatus and a printhead temperature $T_h$ are acquired in step S401. In step S402, print data is received from an external device (host). Then, the process proceeds to step S403 to simulate the transition of the printhead temperature in actual printing from the received data and derive a maximum arrival temperature $T_{max}$ at that time.

In step S404, a target retained temperature $T_k$ at which the printhead temperature is retained is determined in accordance with the maximum arrival temperature $T_{max}$ derived in step S403. In step S405, preprint temperature retaining control starts. If the printhead temperature reaches the target retained temperature, the process proceeds to step S406 to start printing. In step S407, printing is performed while temperature retaining control is executed. When all print data are printed, a series of print operations ends.

The process contents in steps S401 to S407 will be explained in detail.

In step S401, a thermistor 315 in the printing apparatus starts acquiring the ambient temperature $T_a$ of the printing apparatus, and diode sensors 203 in printheads 100 and 101 start acquiring the printhead temperature $T_h$. To always grasp the temperature state, the ambient temperature $T_a$ is updated every second, and the printhead temperature $T_h$ is updated every 0.1 sec. In step S402, print data is received from an external device. Before receiving print data, the values of the ambient temperature $T_a$ and printhead temperature $T_h$ updated in step S401 are set as an initial ambient temperature $T_{a0}$ and initial printhead temperature $T_{h0}$. In step S403, information on a print scanning count $C_s$ for one page of a print medium, a print time $t_{s(i)}$ of each print scanning depending on the print scanning range, and a heater driving count $H_{s(i)}$ per unit time of each print scanning is derived from the received print data. The following equation is repetitively calculated using the initial ambient temperature $T_{a0}$ and initial printhead temperature $T_{h0}$ (i: i=0,$C_s$) times. By this calculation, the transition of a printhead temperature $T_{h(i)}$ before the start of the ith print scanning during printing of one page is derived. The maximum arrival temperature $T_{max}$ of the printhead is obtained (predicted) from the transition.

$$T_{h(i+1)}=T_{h(i)}+U(T_{a(i)},T_{h(i)})\times H_{s(i)}\times t_{s(i)}-D(T_{a(i)},T_{h(i)})\times(t_{s(i)},t_r)$$

where $U(T_{a(i)},T_{h(i)})$ is the temperature rise function of the printhead per discharge (per heater driving), and $D(T_{a(i)},T_{h(i)})$ is the temperature drop function of the printhead per unit time. These functions with respect to "i" change their values depending on the ambient temperature of the printing apparatus and the printhead temperature. $t_r$ is the carriage downtime till the start of the next print scanning after the end of the current print scanning.

Assume that $T_{a0}=T_{h0}=23°$ C., $C_s=175$, $t_{s(i)}=0.4$ sec, and $t_r=0.1$ sec. The above equation is applied to a case where $H_{s(i)}$ changes within the range of 0 to 13,824,000 (=24 kHz×192 orifices×3 colors) times/sec every print scanning, obtaining the transition of the printhead temperature $T_{h(i)}$ before the start of each print scanning when printing one page of a print medium.

Figure 5:
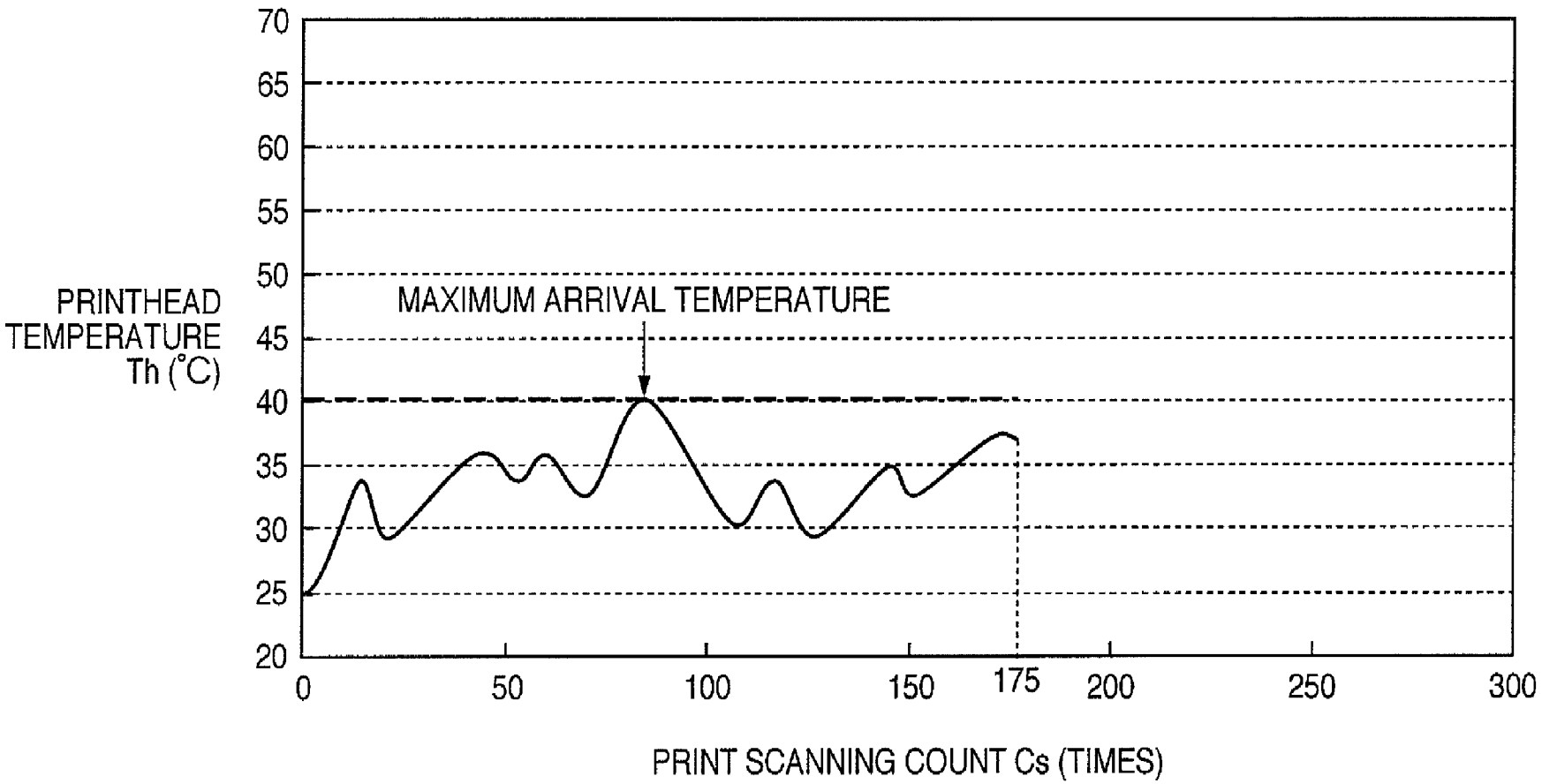
FIG. 5 is a graph showing the transition of a printhead temperature $T_h$ while printing one page of a print medium.

FIG. 5 is a graph showing the transition of the printhead temperature $T_{h(i)}$ before the start of each print scanning when printing one page of a print medium in the above-described example.

In FIG. 5, the maximum arrival temperature $T_{max}$ of the printhead is 40° C.

In step S404, the target retained temperature $T_k$ is determined from the maximum arrival temperature $T_{max}$ (=40° C.) of the printhead obtained in step S403.

FIG. 6 is a table showing the relationship between the maximum arrival temperature and target retained temperature of the printhead.

In the first embodiment, the target retained temperature $T_k$ is determined from the maximum arrival temperature $T_{max}$ based on this table.

It should be note in this table that the maximum arrival temperature $T_{max}$ and target retained temperature $T_k$ of the printhead may not coincide with each other. This is because the target retained temperature $T_k$ is set to be equal to or lower than the maximum arrival temperature $T_{max}$ in order to avoid degradation of the output image quality due to an unstable ink discharge state if the printhead temperature is retained at an excessively high temperature for a predetermined time or more. Since $T_{max}=40°$ C., $T_k=40°$ C. in accordance with this table.

In step S405, preprint temperature retaining control is performed to adjust the printhead temperature $T_h$ to the target retained temperature $T_k$ (=40° C.) determined in step S404.

Figure 7:
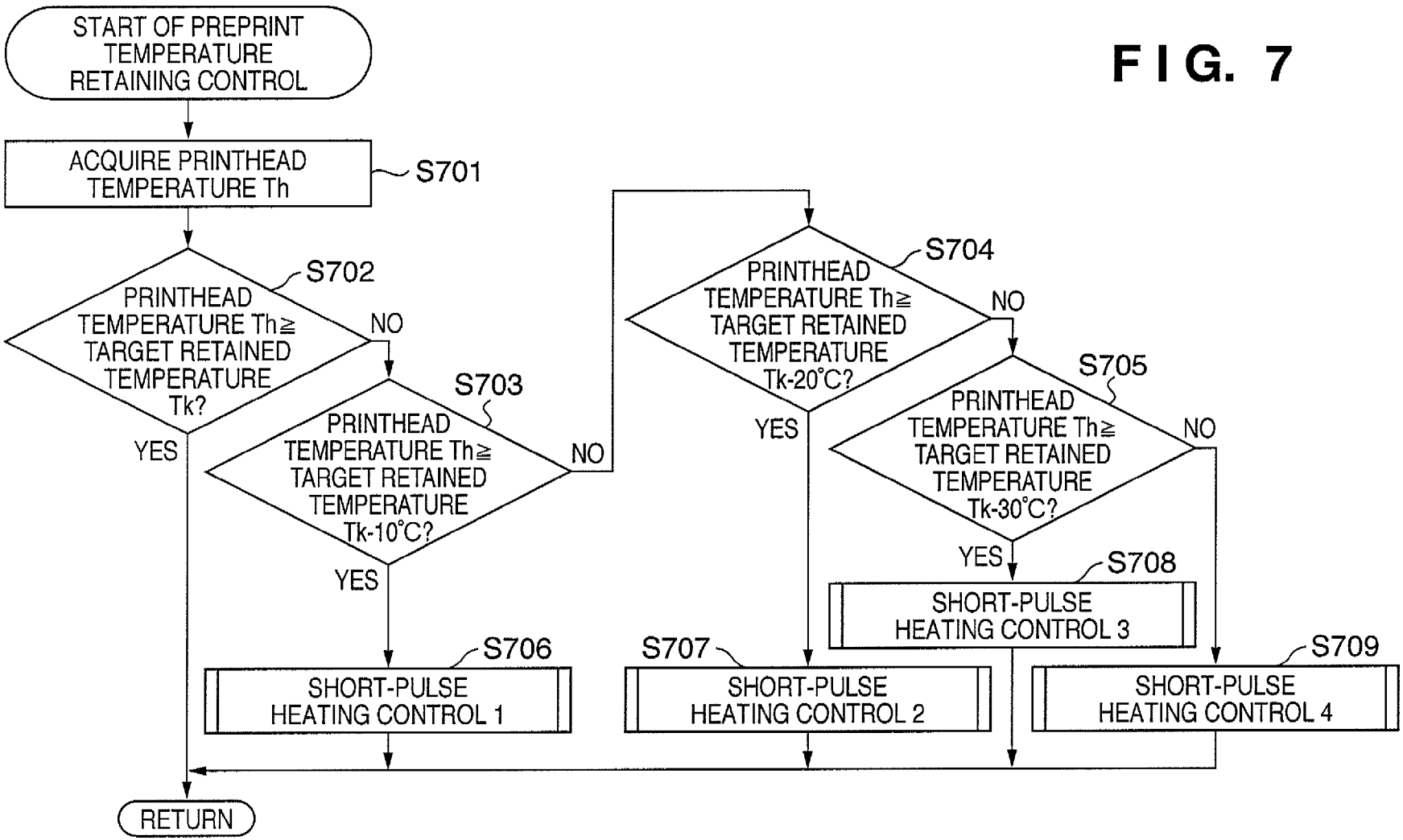
FIG. 7 is a flowchart showing details of preprint temperature retaining control.

FIG. 7 is a flowchart showing details of the preprint temperature retaining control in step S405.

In step S701, the printhead temperature $T_h$ is updated to the latest value. In step S702, the updated value is compared with the target retained temperature $T_k$. If $T_h \geqq T_k$ (=40° C.), the preprint temperature retaining control ends, and the process proceeds to step S406 to start printing. If $T_h<T_k$, the degree of the difference ($T_k-T_h$) is determined in steps S703 to S705. The process branches to one of steps S706 to S709 in accordance with the degree of the difference to perform one of short-pulse heating control 1 to 4.

For example, when $T_h$=20° C., the process proceeds to step S702→step S703→step S704→step S707 to perform short-pulse heating control 2.

The driving conditions of short-pulse heating control 1 to 4 corresponding to steps S706 to S709 are a pulse width of 0.2 μs and a driving frequency of 24 kHz. Short-pulse heating control 1 to 4 are performed for all discharge heaters for 1 sec, 2 sec, 3 sec, and 4 sec, respectively.

After the end of short-pulse heating control 1 to 4, the process returns to step S701 again to update the printhead temperature $T_h$. In step S702, $T_k$ (=40° C.) is compared with $T_h$, and the above-mentioned process is repeated until the difference between them becomes 0 or less.

In the preprint temperature retaining control according to the first embodiment, the amount of heating to the printhead substrate is changed in accordance with the printhead temperature, but the present invention is not limited to this. For example, the ambient temperature of the printing apparatus, and the ink discharge heater driving count per unit time until the amount of heating is changed may further be considered. This enables more accurate temperature retaining control almost free from a temperature shift from the target retained temperature.

After printing starts in step S406, the process proceeds to step S407 to print while performing temperature retaining control in printing.

Figure 8:
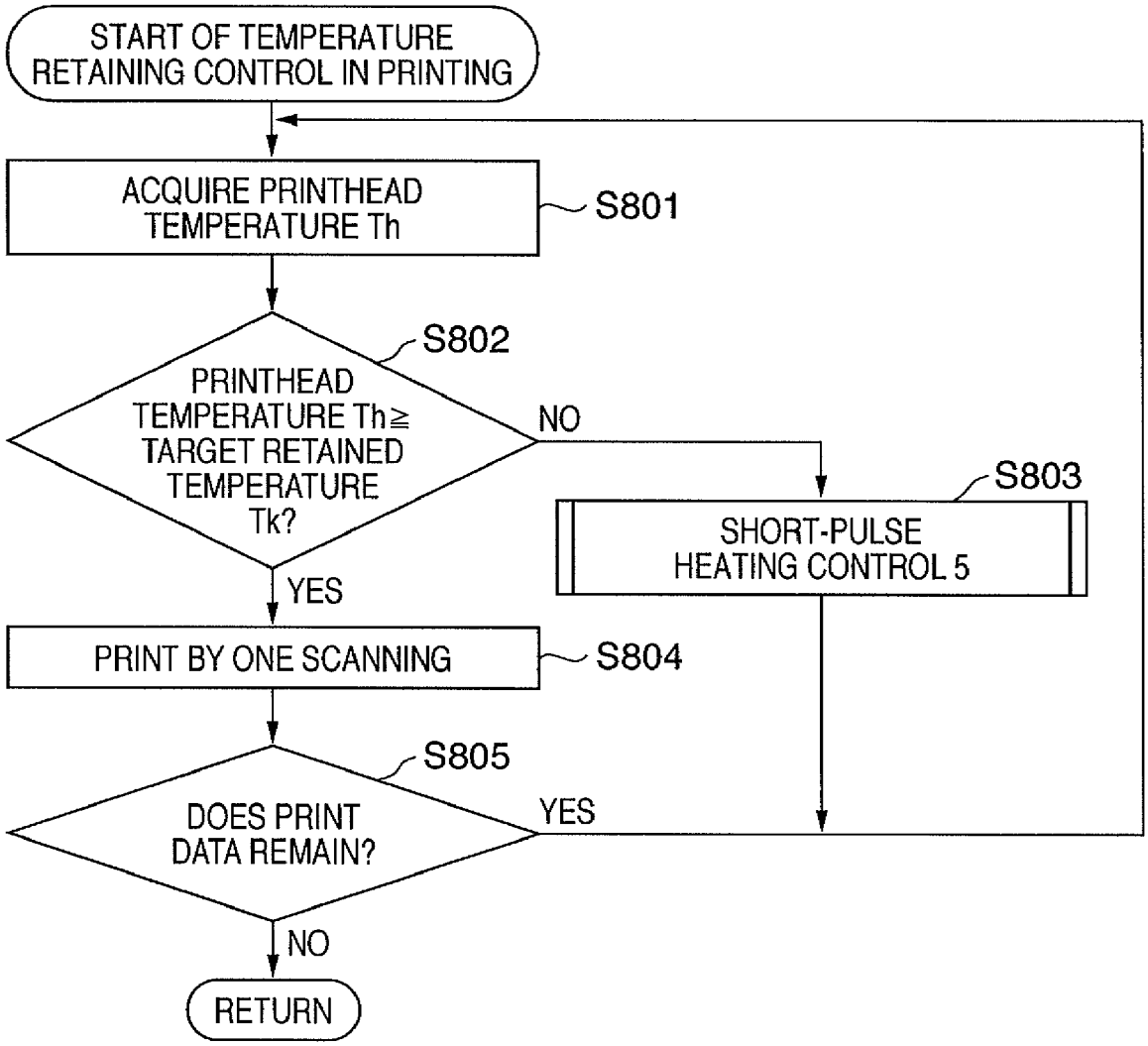
FIG. 8 is a flowchart showing details of temperature retaining control in printing according to the first embodiment.

FIG. 8 is a flowchart showing details of the temperature retaining control in printing in step S407.

The printhead temperature $T_h$ is updated in step S801, and compared with the target retained temperature $T_k$ (=40° C.) in step S802. If $T_h<T_k$ (=40° C.), the process proceeds to step S803 to perform short-pulse heating control 5 during a non-print period when conveying the next print medium. The driving condition of short-pulse heating control 5 is to perform short-pulse heating control for all discharge heaters for 1 sec at a pulse width of 0.2 μs and a driving frequency of 24 kHz. After heating, the process returns to step S801 again to update the printhead temperature $T_h$. In step S802, $T_h$ is compared with $T_k$ (=40° C.) This process is repeated until $T_h \geqq T_k$ (=40° C.).

If $T_h \geqq T_k$ (=40° C.), the process proceeds to step S804 to print by one scanning. After the end of printing by one scanning, it is determined in step S805 whether or not data to be printed remains. If it is determined that print data remains, the process returns to step S801 to repeat the above-described process. If it is determined that no print data remains, the process ends.

In the temperature retaining control in printing according to the first embodiment, the amount of heating to the printhead substrate is changed in accordance with the printhead temperature, but the present invention is not limited to this. For example, the ambient temperature of the printing apparatus, and the ink discharge heater driving count per unit time until the amount of heating is changed may further be considered. This achieves more accurate temperature retaining control almost free from a temperature shift from the target retained temperature.

According to the first embodiment as described above, the maximum arrival temperature of the printhead is predicted using information on print conditions during the print operation, and temperature retaining control is performed based on a target retained temperature determined from the predicted maximum arrival temperature. The first embodiment can suppress not only variations in the amount of ink discharge caused by a maximum arrival temperature higher than a target retained temperature in actual printing, but also wasteful power consumption caused by a maximum arrival temperature lower than a target retained temperature.

According to the first embodiment, an image almost free from color unevenness can be printed at high speed. Since the printhead is not heated more than necessary, power consumption for retaining the printhead temperature can be reduced.

Figure 9:
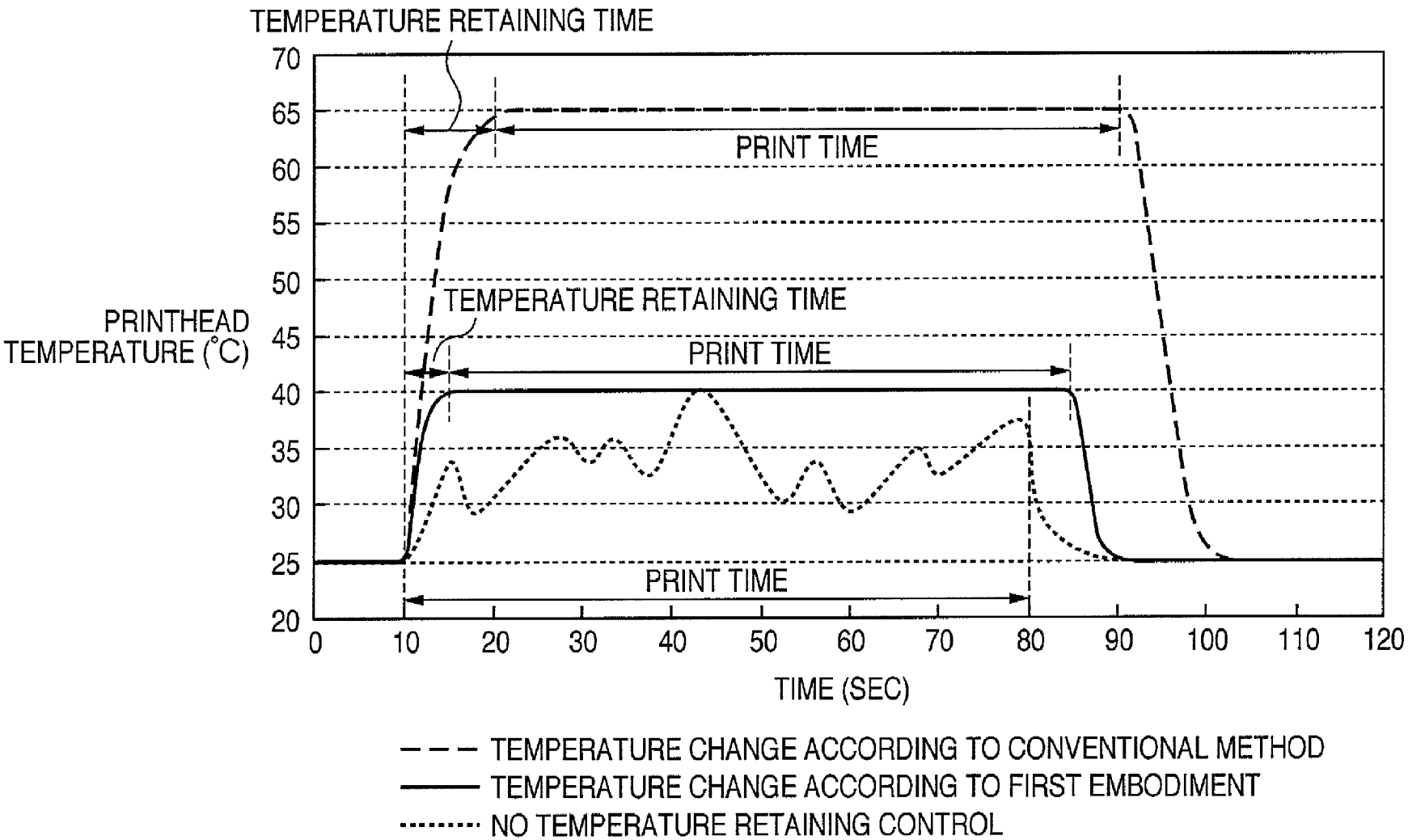
FIG. 9 is a graph showing temperature change of the printhead in a case where printhead temperature retaining control according to the present invention is performed.

FIG. 9 is a graph showing temperature change of the printhead in a case where printhead temperature retaining control according to the first embodiment is performed and a case where the amount of ink discharge is increased and a reference temperature serving as a target retained temperature for stabilizing the amount of discharge is set relatively high, as an example of the conventional arts.

As shown in FIG. 9, the first embodiment can suppress variations in the amount of ink discharge even when the printhead temperature is retained at a target retained temperature (40° C. in this case) lower than a conventional temperature (=65° C.). That is, temperature retaining control according to the first embodiment can adjust the printhead temperature $T_h$ to be constant around the target retained temperature $T_k$ at an early stage at a temperature lower than the temperature of temperature retaining control that is conventionally set high.

In the first embodiment, the maximum arrival temperature of the printhead is derived using the above-described equation. However, the present invention is not limited to this, and the equation can also use information such as the printhead driving time, the non-print time until the start of the next scan printing, the print mode, the print scanning count necessary to complete a predetermined print area, the size of the print area or print medium, the type of print medium, the print data capacity, the number of print media, or the non-print time until the start of printing the next page. As described above, the above information also includes the ink discharge heater driving count per unit time or scanning, the printhead driving time per scanning, the print scanning count, the ambient temperature of the printing apparatus, and the printhead temperature. The equation may also use single information mentioned above or a combination of pieces of information.

Second Embodiment

In the first embodiment, information on the print scanning count, the print time per print scanning, and the heater driving count per unit time for each print scanning is derived from print data, obtaining the maximum arrival temperature of the printhead. However, this control requires complicated calculation. Since the calculation is required to complete before the start of printing, this may decrease the throughput of the printing apparatus. In the first embodiment, since all print data are received before the start of printing, the data transfer time becomes long unless a large-capacity buffer is provided. To prevent a decrease in the throughput of the printing apparatus, a large-capacity memory is necessary, raising the cost of the printing apparatus.

Considering this, the second embodiment will describe a temperature retaining control method which can be performed without requiring any complicated calculation, unlike the first embodiment.

Figure 10:
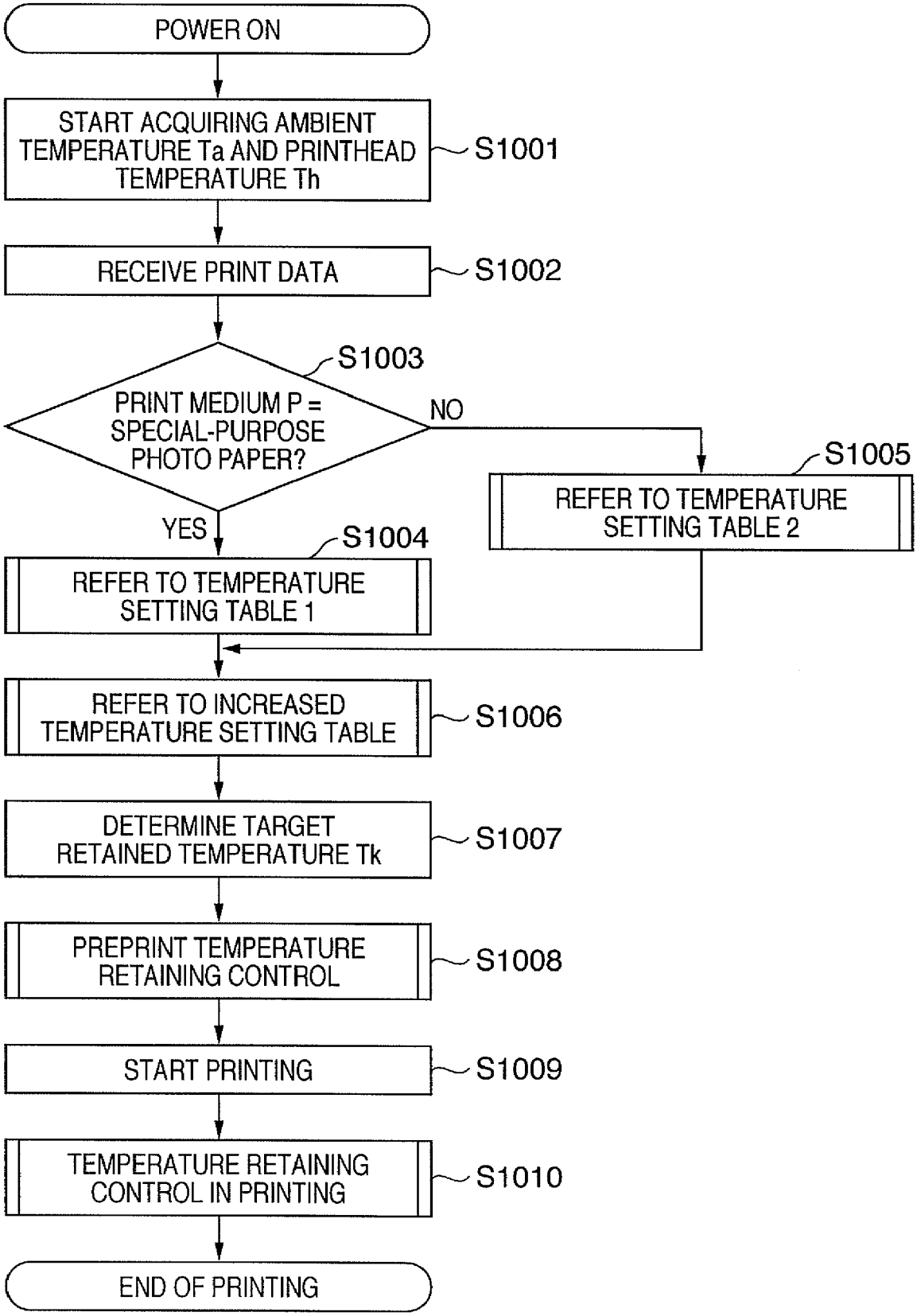
FIG. 10 is a flowchart showing an outline of printhead temperature retaining control according to the second embodiment.

FIG. 10 is a flowchart showing an outline of a printhead temperature retaining control method according to the second embodiment.

When the printing apparatus is turned on, the ambient temperature of a printing apparatus and a printhead temperature are acquired in step S1001. In step S1002, print data is received from an external device. At this time, information on the type of print medium, the print medium size, and the print mode is also received. In step S1003, the type of print medium is determined. In step S1004 or S1005, a provisional target retained temperature is determined in accordance with the determination result, the print medium size, and the print mode.

In step S1006, the correction value of a target retained temperature is derived based on the ambient temperature of the printing apparatus. In step S1007, the target retained temperature is determined by correcting the provisional target retained temperature based on the correction value. In step S1008, preprint temperature retaining control starts. If the printhead temperature reaches the target retained temperature, the process proceeds to step S1009 to start printing. In step S1010, printing is performed while temperature retaining control is performed. When all print data are printed, the process ends.

The processes in steps S1001 to S1010 will be explained in detail.

In step S1001, a thermistor 315 in the printing apparatus starts acquiring an ambient temperature $T_a$ of the printing apparatus, and diode sensors 203 in printheads 100 and 100 start acquiring a printhead temperature $T_h$. These temperatures are updated at the same time intervals as those in the first embodiment. In step S1002, print data is received from an external device. Before receiving print data, the values of the ambient temperature $T_a$ and printhead temperature $T_h$ updated in step S1001 are set as an initial ambient temperature $T_{a0}$ and initial printhead temperature $T_{h0}$, similar to the first embodiment. Further in the second embodiment, information on the type of print medium, the print medium size, and the print mode is also received in step S1002.

This information is added at the head of print data, can be acquired before receiving all print data, and enables the printing apparatus to roughly grasp the maximum arrival temperature of the printhead. With this information, calculation based on the equation used in the first embodiment can be omitted, shortening the calculation time and data transfer time necessary in the first embodiment.

The reason why the information on the type of print medium, the print medium size, and the print mode allows roughly grasping the maximum arrival temperature of the printhead will be described below. For example, the amount of ink printable per unit area is greatly different between plain paper and special-purpose photo paper because of the difference in ink absorptivity. The maximum driving count of the discharge heater changes depending on the type of paper for use, and the temperature rise range of the printhead also greatly changes. As for the print medium size, if the print scanning range is short and the print medium conveyance length (i.e., print scanning count) is short even when printing the same image, the driving count of the ink discharge heater is small, and thus the maximum arrival temperature of the printhead becomes low. As for the print mode, it determines a count (pass count) representing the number of scans by which printing is complete in the same print area. Thus, the print scanning count changes depending on the pass count. The print mode further determines the driving frequency of the ink discharge heater. If the ink discharge heater driving count per unit time changes, the maximum arrival temperature of the printhead greatly changes even for the same image.

For these reasons, in step S1003, the type of print medium is classified into special-purpose photo paper or plain paper. According to the classification, the process branches to step S1004 or S1005.

FIGS. 11A and 11B show two target retained temperature setting tables based on the print medium size and print mode. Target retained temperature setting table 1 shown in FIG. 11A corresponds to special-purpose photo paper. Target retained temperature setting table 2 shown in FIG. 11B corresponds to plain paper. Target retained temperature setting tables 1 and 2 are created on the assumption that the ambient temperature $T_a$ of the printing apparatus is $T_a$=23° C.

In steps S1004 and S1005, a provisional target retained temperature $T_{kt}$ of the printhead is determined by looking up target retained temperature setting tables 1 and 2 respectively shown in FIGS. 11A and 11B.

When the print medium is plain paper, the provisional target retained temperature $T_{kt}$ is determined by looking up target retained temperature setting table 2 in step S1005. For example, when the print medium size is A4 and the set print mode is "fine", $T_{kt}$=38° C.

In step S1006, the correction value of the target retained temperature with respect to the current ambient temperature $T_a$ is derived.

FIG. 12 shows an increased temperature setting table. The correction value of the target retained temperature with respect to the current ambient temperature $T_a$ is derived by looking up the increased temperature setting table.

In step S1007, the target retained temperature $T_k$ is determined by correcting the provisional target retained temperature $T_{kt}$ determined in step S1004 or S1005 based on the correction value derived in step S1006. The method of correcting the provisional target retained temperature based on the correction value of the target retained temperature is a method of adding an increased temperature serving as the correction value to the provisional target retained temperature $T_{kt}$.

For example, when $T_a$=25° C., a correction value (increased temperature) of 2° C. is obtained from the increased temperature setting table. The correction value of 2° C. is added to the provisional target retained temperature of 38° C. determined in step S1005, obtaining a target retained temperature $T_k$ of 40° C.

In step S1008, preprint temperature retaining control is performed to adjust the printhead temperature $T_h$ to the target retained temperature $T_k$=40° C. determined in step S1007.

The preprint temperature retaining control in the second embodiment complies with the flowchart in FIG. 7 described in the first embodiment, and a description thereof will not be repeated.

In step S1009, printing starts. After that, the process proceeds to step S1010 to print while performing temperature retaining control in printing.

Figure 13:
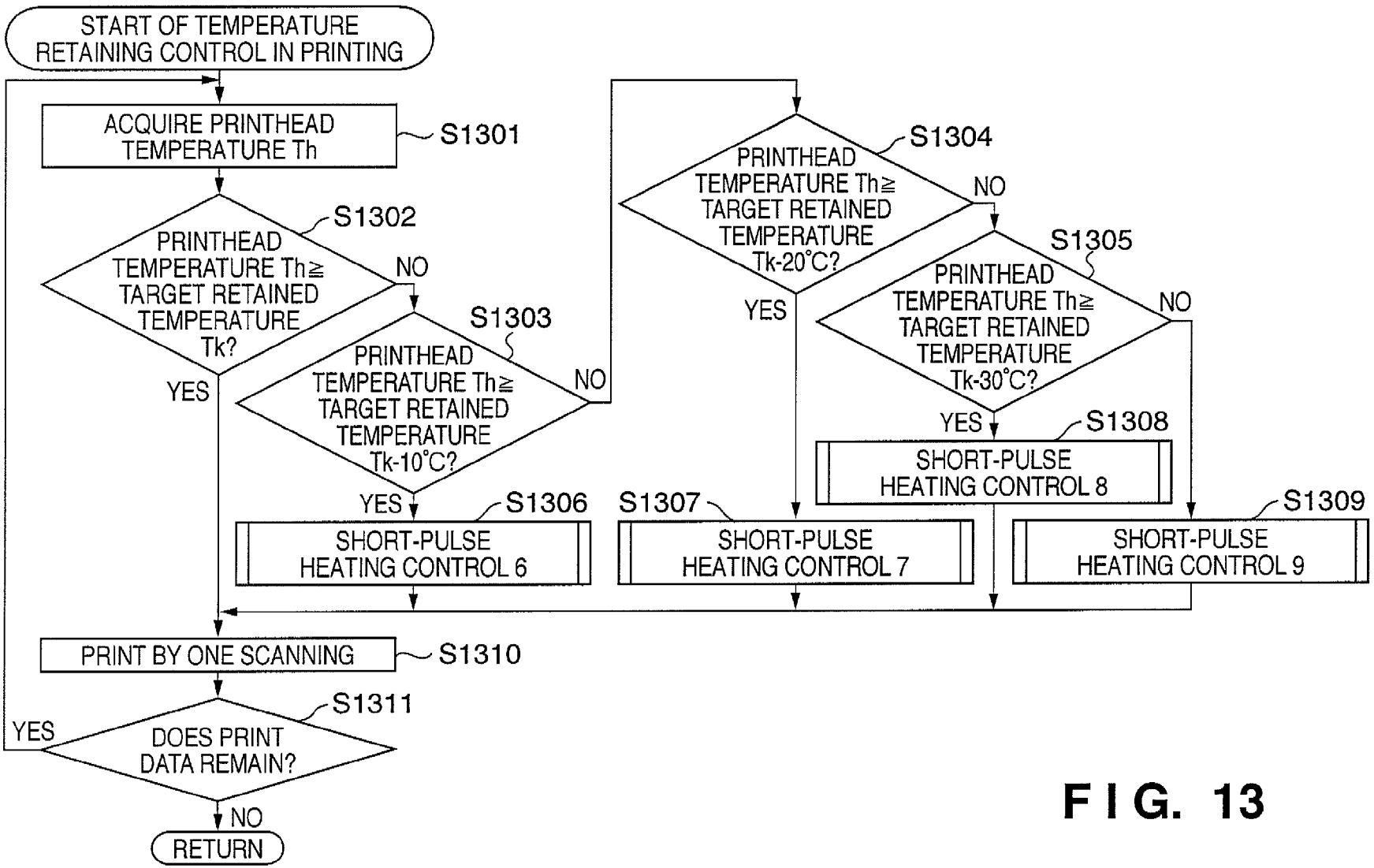
FIG. 13 is a flowchart showing details of temperature retaining control in printing according to the second embodiment.

FIG. 13 is a flowchart showing the temperature retaining control in printing according to the second embodiment.

Steps S1301 to S1309 are control processes performed during a non-print period when conveying a print medium. In step S1301, the printhead temperature $T_h$ is updated. The process proceeds to steps S1302 to S1305, and branches to one of steps S1306 to S1309 in accordance with the degree of the difference between the printhead temperature $T_h$ and the target retained temperature $T_k$ (=40° C.). Then, one of short-pulse heating control 6 to 9 is performed.

For example, when $T_h$=35° C., the process proceeds to step S1302 →step S1303 →step S1306 to perform short-pulse heating control 6.

Driving conditions common to short-pulse heating controls 6 to 9 are a pulse width of 0.2 μs and a driving frequency of 24 kHz. Short-pulse heating controls 6 to 9 are performed for all discharge heaters for 1 sec, 2 sec, 3 sec, and 4 sec, respectively.

After the end of short-pulse heating controls 6 to 9 corresponding to steps S1306 to S1309, if it is determined in step S1302 that $T_h \geqq T_k$ (=40° C.), the process proceeds to step S1310 to print by one scanning. After the end of printing by one scanning, the process proceeds to step S1311 to determine whether or not data to be printed remains. If it is determined that print data remains, the process returns to step S1301 to repeat the above-described process. If it is determined that no print data remains, the process ends.

In the temperature retaining control in printing according to the second embodiment, the amount of heating to the printhead substrate is changed in accordance with the printhead temperature, but the present invention is not limited to this. For example, the ambient temperature of the printing apparatus, and the ink discharge heater driving count per unit time until the amount of heating is changed may further be considered. This enables more accurate temperature retaining control almost free from a temperature shift from the target retained temperature.

According to the second embodiment, similar to the first embodiment, the maximum arrival temperature of the printhead is predicted using information on print conditions during the print operation, and temperature retaining control is performed based on a target retained temperature determined from the predicted maximum arrival temperature. The second embodiment can, therefore, suppress not only variations in the amount of ink discharge caused by a maximum arrival temperature higher than a target retained temperature in actual printing, but also wasteful power consumption caused by a maximum arrival temperature lower than a target retained temperature.

Also according to the second embodiment, an image almost free from color unevenness can be printed at high speed. Since the printhead is not heated more than necessary, power consumption for retaining the printhead temperature can be reduced.

The second embodiment can advantageously determine a target retained temperature and perform printhead temperature retaining control without using complicated calculation as employed in the first embodiment.

As shown in FIG. 9, similar to the first embodiment, the second embodiment can suppress variations in the amount of ink discharge even when the printhead temperature is retained at a target retained temperature (40° C. in this case) lower than a conventional temperature (=65° C.). That is, temperature retaining control according to the second embodiment can adjust the printhead temperature $T_h$ to be constant around the target retained temperature $T_k$ at an early stage at a temperature lower than the temperature of temperature retaining control that is conventionally set high.

In the second embodiment, the maximum arrival temperature of the printhead is derived using information on the type of print medium, the print medium size, the print mode, and the ambient temperature of the printing apparatus. However, the present invention is not limited to this. For example, the present invention can use the ink discharge heater driving count per unit time or scanning, the printhead driving time, the printhead driving time per scanning, the non-print time till the start of the next scan printing, the print scanning count, and the print scanning count necessary to complete a predetermined print area. In addition, the present invention can also use the print area size, the print data capacity, the number of print media, and the non-print time till the start of printing the next page. As already described above, the present invention can also use the type of print medium, the print medium size, the print mode, the ambient temperature of the printing apparatus, and the printhead temperature. The maximum arrival temperature may also be derived using single information mentioned above or a combination of pieces of information.

In the first and second embodiments, one page of a print medium is printed. The temperature retaining control method described in these embodiments is also applicable to a case where a plurality of pages are successively printed by one job. In this case, the maximum arrival temperature may change between the first and second pages depending on the printhead temperature. If the target retained temperature changes, the density may differ between the first and second pages. In this case, the maximum arrival temperature of the printhead for a plurality of pages by one job is derived, obtaining the same effect as that when printing one page. More specifically, the number of print media and the non-print time until the start of printing the next page are added to calculation. The maximum arrival temperature of the printhead during continuous printing over plural pages is detected, and a target retained temperature corresponding to the detected temperature is set.

If the heater driving count excessively increases or decreases during printing, it is difficult to keep the printhead temperature constant even by performing temperature retaining control. In this case, it is effective to employ double-pulse PWM control (see Japanese Patent Laid-Open No. 5-92565) capable of controlling the amount of ink discharge, in addition to the above-described short-pulse heating control. The double-pulse PWM control is a technique of keeping the amount of ink discharge constant by changing, in accordance with the head temperature, the width of a pre-pulse in a heat pulse composed of the pre-pulse and a main pulse. Even if the heater driving count greatly changes and the printhead temperature still varies while performing temperature retaining control, the use of temperature retaining control and PWM control can suppress variations in the amount of ink discharge.

The amount of ink discharge can be kept constant in a wide range of ink temperatures by using the double-pulse PWM control and single-pulse PWM control of modulating a main pulse by a single pulse. A circuit for modulating the printhead driving voltage may also be arranged to perform voltage modulation control. The voltage modulation driving control is a technique of keeping the amount of ink discharge constant regardless of the ink temperature, similar to PWM control, based on the fact that the amount of ink discharge decreases as the printhead driving voltage rises.

In the first and second embodiments, the printing apparatus obtains the maximum arrival temperature of the printhead. However, the present invention is not limited to this. For example, the printing system may also be configured such that a host device which transmits print data obtains the maximum arrival temperature, and the printing apparatus receives information on the maximum arrival temperature obtained by the host device and performs temperature retaining control based on the information.

The first and second embodiments derive the transition of the printhead temperature before the start of print scanning that is acquired during the carriage downtime till the start of the next print scanning after the end of the current print scanning. However, the present invention is not limited to this. As the timing when the printhead temperature is acquired is earlier, a more accurate maximum arrival temperature of the printhead can be attained.

In the above-described embodiments, an image is printed by discharging only ink from the printhead. However, the material discharged from the printhead is not limited to the ink, and also includes a processed liquid for improving the fixing characteristic and water repellency of a printed image and improving the print quality. That is, the present invention is also applicable to an arrangement which prints an image by, for example, a combination of ink and processed liquid.

In addition, the printing apparatus to which the present invention is applicable may take the form of an image output apparatus for an information processing apparatus such as a computer, the form of a copying apparatus combined with a reader or the like, and the form of a facsimile apparatus having transmission and reception functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-336376, filed Dec. 13, 2006, which is hereby incorporated by reference herein in its entirety.

What is claimed is:

1. A printing apparatus which prints on a print medium by scanning a printhead having a printing element for generating thermal energy, the apparatus comprising:

determination means for predicting a maximum temperature which the printhead reaches in printing, and determining a target temperature on the basis of the predicted maximum temperature; and adjustment means for adjusting a temperature of the printhead in printing on the basis of the target temperature.

2. The apparatus according to claim 1, wherein said determination means predicts the maximum temperature on the basis of a condition in printing.

3. The apparatus according to claim 2, wherein said determination means derives the condition in printing by using print data to be printed by the printhead.

4. The apparatus according to claim 2, further comprising:

ambient temperature detection means for detecting an ambient temperature of the printing apparatus; and printhead temperature detection means for detecting a temperature of the printhead, wherein said determination means derives the condition in printing by using the ambient temperature and the temperature of the printhead.

5. The apparatus according to claim 2, wherein said determination means determines the target temperature by using a table representing a relationship between the condition in printing and the target temperature, and a correction value for the table.

6. The apparatus according to claim 2, wherein said determination means derives the condition in printing by using at least one of the following information:

a driving count of the printing element per unit time;

a driving count of the printing element per scanning;

a driving time of the printhead;

a driving time of the printhead per scanning;

a non-print time until start of next scan printing;

a print scanning count;

a print mode;

a scanning count to complete printing in the same print area on the print medium;

a print area;

a size of the print medium;

a type of the print medium;

a print data capacity;

a number of print media;

a non-print time until start of printing a next page;

an ambient temperature of the printing apparatus; and a temperature of the printhead.

7. The apparatus according to claim 1, wherein said determination means determines a first target temperature on the basis of a first maximum temperature predicted as the maximum temperature when the printhead prints at a first timing, and a second target temperature on the basis of a second maximum temperature predicted as the maximum temperature when the printhead prints at a second timing, and the second maximum temperature is higher than the first maximum temperature, and the second target temperature is higher than the first target temperature.

8. The apparatus according to claim 1, wherein said determination means predicts the maximum temperature which the printhead reaches when printing on a plurality of print media.

9. The apparatus according to claim 1, further comprising:

printhead temperature detection means for detecting a temperature of the printhead; and driving means for driving the printing element by changing a pulse width of a driving signal for driving the printhead in accordance with the temperature of the printhead.

10. A printing system including a printing apparatus and a host connected to the printing apparatus, the printing apparatus including a printhead having a printing element for generating thermal energy, and adjustment means for adjusting a temperature of the printhead in printing on the basis of a target temperature, wherein the host includes:

determination means for predicting a maximum temperature which the printhead reaches in printing, and determining the target temperature on the basis of the predicted maximum temperature; and transmission means for transmitting information on the target temperature to the printing apparatus, the printing apparatus includes reception means for receiving the information on the target temperature from the host, and said adjustment means adjusts the temperature of the printhead on the basis of the received information on the target temperature.

11. A printhead temperature retaining control method in a printing apparatus capable of adjusting, on the basis of a target temperature, a temperature of a printhead with a printing element for generating thermal energy, the method comprising:

a determination step of predicting a maximum temperature which the printhead reaches in printing, and determining the target temperature on the basis of the predicted maximum temperature; and an adjustment step of adjusting the temperature of the printhead on the basis of the determined target temperature.

* * * * *